US009897300B2

(12) United States Patent
Kim et al.

(10) Patent No.: US 9,897,300 B2
(45) **Date of Patent: *Feb. 20, 2018**

(54) LIGHTING DEVICE

(71) Applicant: LG ELECTRONICS INC., Seoul (KR)

(72) Inventors: Jeonghwa Kim, Seoul (KR); Sangman Kim, Seoul (KR); Heegu Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/378,376

(22) Filed: Dec. 14, 2016

(65) Prior Publication Data

US 2017/0167708 A1 Jun. 15, 2017

(30) Foreign Application Priority Data

Dec. 15, 2015 (KR) ..... 10-2015-0178784

(51) Int. Cl.
*H05B 37/02* (2006.01)
*F21V 3/00* (2015.01)
(Continued)

(52) U.S. Cl.
CPC ..... *F21V 23/06* (2013.01); *F21V 3/00* (2013.01); *F21V 23/003* (2013.01);
(Continued)

(58) Field of Classification Search
CPC ..... H05B 33/0842; H05B 37/0245; H05B 33/0845; H05B 33/0854; H05B 37/0272;
(Continued)

(56) References Cited

U.S. PATENT DOCUMENTS 6,388,399 B1 5/2002 Eckel et al.
7,888,875 B2 2/2011 Sibout
(Continued)

FOREIGN PATENT DOCUMENTS

KR 20-2009-0006143 6/2009
KR 10-1316871 10/2013
(Continued)

OTHER PUBLICATIONS

Korean Notice of Allowance dated Feb. 1, 2017 issued in Application No. 9-5-2017-007973831.
(Continued)

*Primary Examiner* — Vibol Tan
(74) *Attorney, Agent, or Firm* — KED & Associates LLP

(57) ABSTRACT

A lighting device may include a light irradiation portion, a light control portion, a sensing portion and a main control module. The light irradiation portion to generate and irradiate light. The light control portion to control a power applied to the light irradiation portion. The sensing portion to sense an environment of a space to which the light irradiation portion irradiates light. The main control module communicate with an external device by a wireless communication and control the light control portion according to a control signal from the external device. The main control module may include a first connector that connects the main control module and the sensing portion by a wired communication. The second connector may connects the light control portion and the main control module by the wired communication. The lighting device may be capable of being installed in an environment desired by the user.

20 Claims, 5 Drawing Sheets

(51) Int. Cl.

| | |
|---|---|
| ***F21V 23/00*** | (2015.01) |
| ***F21V 23/06*** | (2006.01) |
| ***H01R 13/66*** | (2006.01) |
| ***H05B 33/08*** | (2006.01) |
| ***F21V 25/12*** | (2006.01) |

(52) U.S. Cl.
CPC ..... *F21V 23/006* (2013.01); *F21V 25/12* (2013.01); *H01R 13/6683* (2013.01); *H05B 33/0854* (2013.01); *H05B 37/0227* (2013.01); *H05B 37/0254* (2013.01); *H05B 37/0272* (2013.01)

(58) Field of Classification Search
CPC ..... H05B 37/0254; H05B 37/0227; F21Y 2115/10; F21V 23/0435; F21V 23/003; F21V 23/045; F21V 23/06; F21V 23/006; H01R 13/6683
See application file for complete search history.

(56) References Cited

U.S. PATENT DOCUMENTS

| | | | | |
|---|---|---|---|---|
| 8,033,686 | B2 | 10/2011 | Recker | |
| 8,952,626 | B2 | 2/2015 | Huang et al. | |
| 9,024,536 | B2 * | 5/2015 | Maxik | H05B 33/0845 315/113 |
| 9,289,574 | B2 * | 3/2016 | Maxik | H05B 33/086 |
| 9,295,144 | B2 * | 3/2016 | Bora | H05B 33/0863 |
| 9,320,101 | B2 * | 4/2016 | Sun | H05B 33/0845 |
| 9,408,282 | B1 | 8/2016 | Springer | |
| 9,536,452 | B2 | 1/2017 | Lydecker et al. | |
| 9,538,620 | B2 * | 1/2017 | Kim | F21K 9/23 |
| 9,538,623 | B2 * | 1/2017 | Lee | F21K 9/238 |
| 9,549,110 | B2 * | 1/2017 | Chien | F21V 33/0052 |
| 9,603,226 | B2 * | 3/2017 | Sagal | H05B 37/0227 |
| 2007/0147017 | A1 | 6/2007 | Eom | |
| 2015/0327349 | A1 * | 11/2015 | Lee | F21K 9/238 362/294 |
| 2017/0130907 | A1 * | 5/2017 | Cho | F21K 9/238 |
| 2017/0167708 | A1 * | 6/2017 | Kim | F21V 23/06 |
| 2017/0167709 | A1 * | 6/2017 | Kim | F21V 23/06 |
| 2017/0171944 | A1 * | 6/2017 | Kim | H05B 37/0227 |

FOREIGN PATENT DOCUMENTS

| | | |
|---|---|---|
| KR | 10-2014-0056995 | 5/2014 |
| KR | 10-2014-0060675 | 5/2014 |
| KR | 10-2014-0098570 | 8/2014 |
| KR | 10-2014-0024583 | 6/2015 |
| KR | 10-2015-0135862 | 12/2015 |
| KR | 10-1617293 | 5/2016 |

OTHER PUBLICATIONS

U.S. Notice of Allowance issued in U.S. Appl. No. 15/378,616 dated Sep. 13, 2017.
Korean Office Action dated May 22, 2017 issued in Application No. 10-2015-0178795.
United States Office Action dated Sep. 1, 2017 issued in co-pending related U.S. Appl. No. 15/378,477.

* cited by examiner

LIGHTING DEVICE

CROSS-REFERENCE TO RELATED APPLICATION

The present application claims priority under 35 U.S.C. 119 and 35 U.S.C. 365 from Korean Patent Application No. 10-2015-0178784, filed on Dec. 15, 2015, the subject matter of which is hereby incorporated by reference.

BACKGROUND

1. Field

Embodiments may relate to a lighting device.

2. Background

A light emitting diode has been widely used rather than an incandescent lamp and/or a fluorescent lamp. The light emitting diode (LED) is a type of semiconductor device that converts electrical energy into light. Since the light emitting diode has advantages that are capable of obtaining low power consumption and semi-permanent lifetime compared to a light source such as fluorescent lamps and incandescent lamps, the light emitting diode may be used as a light source of a lighting device such as various liquid crystal display devices, electric sign boards, and street lamps (used indoors and outdoors).

The light emitting diode may be capable of realizing excellent controllability, fast response speed, high electric/light conversion efficiency, high luminance, and/or emotional illumination. Due to characteristics of these devices, the lighting device using the light emitting diode may be positively controlled depending on time and place.

Technologies for saving more power consumption or for more positively controlling the lighting device according to a user's demand have attracted attention. For example, when a moving body sensor determines that there is no person in a lighting space for a predetermined period of time, then the lighting device may be automatically turned off, and when the moving body sensor determines that there is a person in the lighting space, then the lighting device may be automatically turned on.

In order to positively control the lighting device, a communication device may be mounted on the lighting device such that the lighting device is capable of operating according to a control signal from outside of the lighting device. For example, a communication module mounted on an inside of the lighting device is disclosed in Korean Patent Application No. 10-2014-0028495, filed Mar. 11, 2014 (filed by the present applicant), the subject matter of which is incorporated herein by reference In the above technology, technology is disclosed in which the communication module is mounted on an inside of the lighting device, and the communication module performs communication with a remote control device. This technology may not be introduced separately for asensor.

Korean Patent Laid-Open Publication No. 10-2014-0098570, filed Jan. 31, 2013, the subject matter of which is incorporated herein by reference, discloses a technology that allows a sensing signal from a sensor to be transmitted to a gateway, and a controller that controls the gateway and thus controls a light irradiation portion. Korean Patent Laid-Open Publication No. 10-2014-0098570 was filed by the present applicant, and includes a technology for a sensor capable of interlocking with the lighting device.

According to this technology, a sensor and a light irradiation portion are separate articles from each other and are independently installed and operated. Accordingly, a separate installer may register the sensor in a complicated process using a controller when installing the lighting device, and may register an operation system of the lighting device according to a sensing state of the sensor. Accordingly, if the sensor, the light irradiation portion, and the communication module are different from each other, then all separate installation processes are to be performed. The installation process may be more inconvenient because the installation process requires not only a hardware installation process but also a software installation process. Therefore, it may be difficult for a user to install the lighting device.

BRIEF DESCRIPTION OF THE DRAWINGS

Arrangements and embodiments may be described in detail with reference to the following drawings in which like reference numerals refer to like elements and wherein.

DETAILED DESCRIPTION

In the following description of embodiments, in order to facilitate understanding, the attached drawings and/or figures may be illustrated in a larger, smaller or modified form, unlike the reality.

Figure 1:
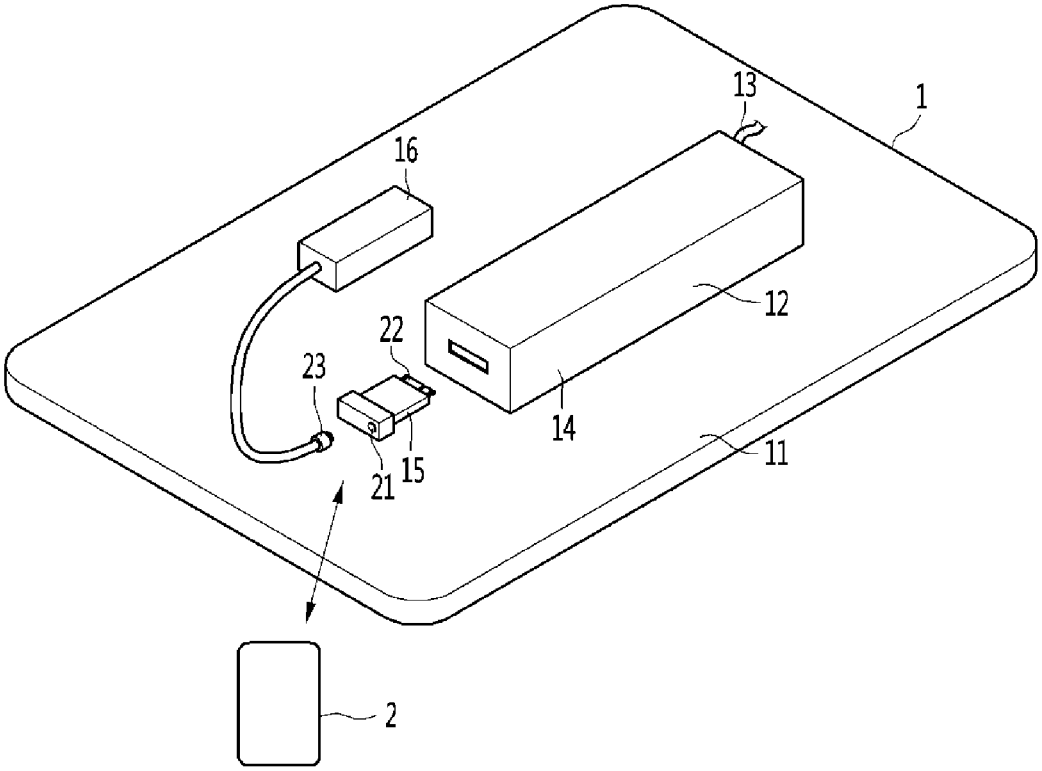
FIG. 1 is a view illustrating an operating state of a lighting device according to an embodiment.

FIG. 1 is a view illustrating an operating state of a lighting device according to an embodiment. Other arrangements and configurations may also be provided.

FIG. 1 shows a lighting device 1 for irradiating light and an external device 2 for transmitting a control signal for controlling the lighting device 1 in various methods using a control factor such as time, illuminance, and/or color. The external device may be a handheld device, for example, but any type of device including an input unit, a control unit (or contoller), a memory, and/or a transmitting and receiving unit may be used. The transmitting and receiving unit may be a wireless transmitting and receiving unit.

The lighting device 1 may include a light irradiation portion 11, a light control portion 12, a sensing portion 16 and a main control module 15. The light irradiation portion 11 may irradiate light using a light emitting unit that is capable of being typified by a light emitting diode. The light control portion 12 may transmit light by controlling power applied to the light irradiation portion 11 using a predetermined method. The sensing portion 16 may be provided at one side of the light irradiation portion 11 and may sense various states of the environment on which the light irradiation portion 11 is provided. The main control module 15 r nay be connected to the light control portion 12 by wired communication, and may be connected to the external device 2 by wireless communication.

The main control module 15 and the sensing portion 16 may be connected (or coupled) in a detachable manner. The main control module 15 may be provided with a first connector 21 and a second connector 22. A connecting member 23 may be provided at an end of a connection line extending from the sensing portion 16. The main control module 15 may be a main control device or apparatus.

The main control module 15 and the light control portion 12 may be connected (or coupled) in a detachable manner. The main control module 15 may be provided with the second connector 22. The light control portion 12 may include a slot, such as slot 141 shown in FIG. 6.

The sensing portion 16 and the light control portion 12 are fastened to each other such that the sensing portion 16 and the light control portion 12 are detachable from the main control module 15. The specific connecting method of connecting components is not limited to the above described method. A method may be provided in which any one of both components is inserted, both components are connected to each other so that energization is possible, and positions of both components are physically fixed. Both components may be capable of being easily separated by a predetermined external force applied by an operator.

Various types of devices (such as a flat panel illumination, a fluorescent lamp, a down light, and/or a troffer) may be used for the light irradiation portion 11. A commercial power supply 13 may be applied to the light control portion 12. the electricity from the commercial power supply 13 may be regulated in accordance with the control signal from the main control module 15, and the electricity may then be applied to the light emitting unit of the light irradiation portion 11.

The light control portion 12 may be separated from the external environment by a case 14 that prevents foreign material from entering. The case 14 may be made of a metal for shielding electromagnetic waves and preventing fire.

Even if the main control module 15 is fastened to the light control portion 12, at least a portion of the main control module 15 (such as a wireless communication means that includes an antenna) may be exposed to an outside of the light control portion 12 for wireless transmission/reception with the external device 2.

Since the main control module 15 is exposed to outside of the lighting device 1, operations such as replacement of the sensing portion 16 or the main control module 15 may be performed after assembly of the lighting device is completed.

A method of using the lighting device may be described.

The user may select the desired sensing portion 16 at a store, for example. Examples of the sensor (of the sensing portion), which may be selected by the user, may include various type of sensors such as a moving body sensor capable of sensing movement, an illuminance sensor, a temperature sensor, a humidity sensor, a dust sensor, an ultraviolet sensor and/or a gas sensor, for example. A sensor in which two or more of the sensors are installed together may be selected. For example, a sensing portion having both the moving body sensor and the illuminance sensor may be selected. A line may extend in the sensing portion 16, and the connecting member 23 may be provided at an end of the extending line, The user may select a desired light irradiation portion 11 and a light control portion 12 for controlling the selected light irradiation portion 11. A slot 141 may be provided at the light control portion 12. An installation area for mounting the sensing portion 16 may be provided at one side of the light irradiation portion 11. The sensing portion 16 may be installed downward at a mounting area. For example, the light irradiation portion 11 may be empty, or an edge portion of the light irradiation portion 11 may be an installation area.

The user may select the sensing portion 16, the light irradiation portion 11 and the light control portion 12, desired by the user, by using the main control module 15, and the user may assemble the sensing portion 16, the light irradiation portion 11 and the light control portion 12.

When a lighting device is installed at a desired place and power is applied to the lighting device, and software corresponding to types of a sensor in the sensing portion 16, the light irradiation portion and light control portion may be read and then the lighting device may be installed. Information corresponding to various sensors, light irradiation portions, and the light control portions may be stored, in advance, in memory of the main control module 15.

Thereafter, the lighting device may operate using the external device 2 in specific and various methods. For example, operations such as on/off, brightness adjustment, and/or illumination time setting may be performed.

Figure 2:
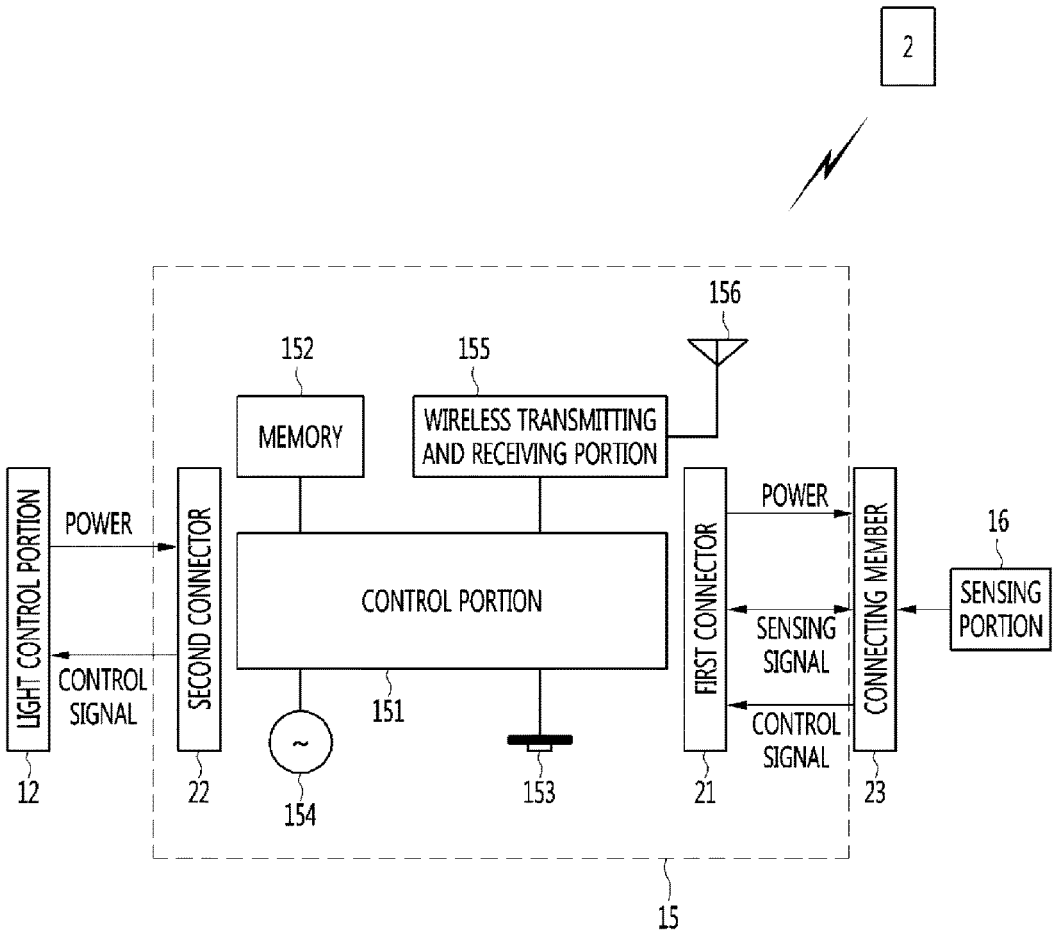
FIG. 2 is a block diagram illustrating a configuration of a main control module.

FIG. 2 is a block diagram illustrating a configuration of the main control module. Other embodiments and configurations ay also be provided.

As shown in FIG. 2, the light control portion 12 may be connected (or coupled) to the main control module 15 by a second connector 22 in a wired communication method. The main control module 15 may receive power from the light control portion 12 through the second connector 22, and may transmit a control signal to the light control portion 12 through the second connector 22, and then adjust a light irradiation state of the light irradiation portion 11. Various methods such as BALI, 0-10 light control, PWM, UART, SPI, I2C, and RS-485 may be the wired communication method to perform signal transmission and reception.

The second connector 22 may include a mode pin. The control method of the light control portion 12 may be based on a signal that is read through the mode pin. For example, when the operation method of the light control portion 12 is pulse width modulation (PWM), then the light control portion 12 may transmit 0 V to the main control module 15 through the mode pin, and the main control module 15 may transmit the control signal to be sent to the light control portion 12 by using the PWM method, by recognizing that 0 V is applied to the mode pin.

The operation mode of the light control portion 12 may be set in advance by software processing and hardware processing, and various communication methods may be stored, in advance, in the main control module 15. The voltage setting of the mode pin may be variously changed according to type of the wired communication method and setting value of the light control portion 12. The mode pin may not be limited to being operated by the voltage value, and a mode may be transmitted by another setting value, such as a specific pulse method.

The sensing portion 16 may be connected to (or coupled to) the main control module 15 (by the wired communication method) by the first connector 21 and the connecting member 23. Power may be transmitted from the main control module 15 to the sensing portion 16 through the first connector 21, and a sensing signal of the sensing portion 16 may be transmitted to the main control module 15. A signal for controlling the sensor of the sensing portion 16 may also be transmitted. Various methods such as DALI, 0-10 light control, PWM, UART, SPI, I2C, and RS-485 may be applied as the wired communication method to perform signal transmission and reception.

Similar to the second connector 22, the first connector 21 may include a mode pin such that operation of the sensor may be reliably performed. For example, by applying different voltages to the mode pins according to types of the sensors, the main control module 15 may identify types of the sensors by using voltages that are applied to the mode pins, controlling the sensor by using different sensing signals from each other according to types of sensors, and recognizing the sensing signal from the sensor. The operation method of the mode pin may not be limited to the voltage value, and a mode may be transferred by another set value, such as a specific pulse type.

The sensing portion 16 may include a switch to which the user may apply an input signal. Because the sensing portion 16 is exposed to the outside, the user may directly perform the operation by the switch. In this example, a control signal from the switch may be transmitted to the main control module 15 through the first connector 21.

The external device 2 may be connected (or coupled) to the main control module 15 in the wireless communication method by an antenna 156. As the wireless communication method, various methods such as ZigBee, Bluetooth, Wi-Fi, and sub-GHZ may be applied to perform signal transmission and reception. For example, a ZigBee SoC may be provided as a control portion 151 (or controller) that entirely controls the main control module 15 so that the main control module 15 supports the Zig Bee method, and an EM 357 may be a more specific example.

The main control module 15 may include a quartz 154, which may be for time control of the control portion 151, a switch 165 for performing operations such as setting and resetting of the main control module 15, a memory 152 for storing a plurality of members of information for the antenna 156, and a wireless transmitting and receiving portion 155 for controlling signal transmission and reception through the antenna 156.

Various information may be stored in the memory 152. Therefore, when the sensing portion 16 and the light control portion 12 are replaced, information for the operation thereof may be read and used, and thus the lighting device may be continuously used without replacing the entire components.

When a large amount of information needs to be uploaded to the memory 152, the external storage device may be connected to the first connector 21 to upload the data. The first connector 21 may include a UART port. An advantage may be obtained in terms of time and power consumption as compared with an example of uploading information using the antenna 156 by a wireless communication.

Figure 3:
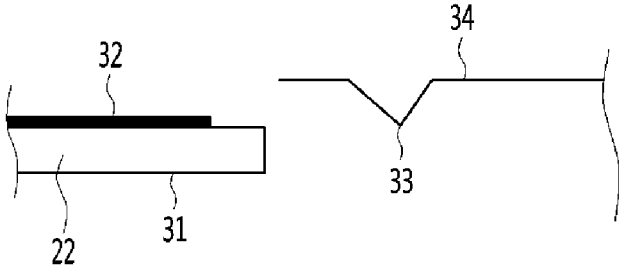
FIG. 3 is a side view illustrating insertion of a second connector.
Figure 4:
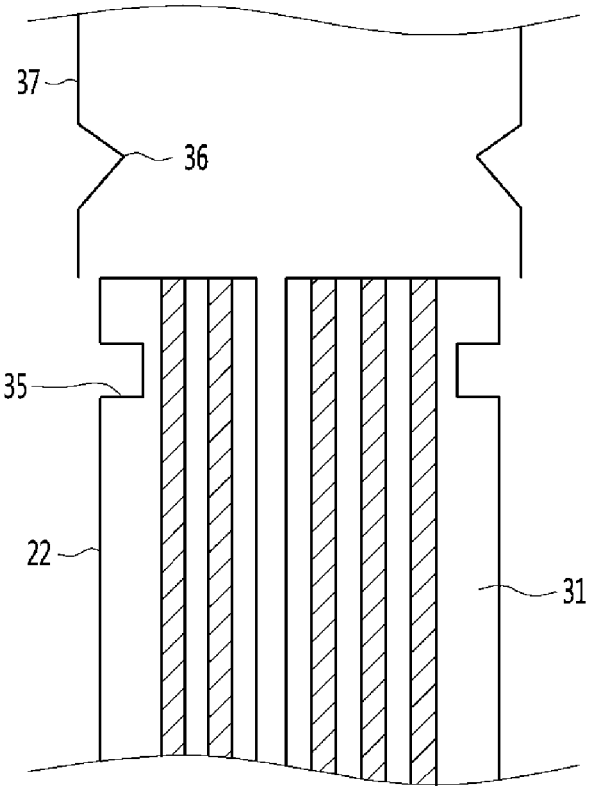
FIG. 4 is a plan view illustrating insertion of a second connector.

FIG. 3 and FIG. 4 are a side view and a plan view illustrating insertion of a second connector, respectively. Other embodiments and configurations may also be provided.

With reference to FIG. 3, the second connector 22 may include a printed circuit board 31, which extends from a main body of the main control module 15 to the outside, and a conductive layer 32, which is printed on an upper surface of the printed circuit board 31. A support member 34 and a contact point 33 may be provided at an inside of the light control portion 12 into which the second connector 22 is inserted.

The contact point 33 may be provided in a configuration in which the support member 34 is bent at an end of the support member 34. The contact point 33 and the conductive layer 32 may be in contact with each other, and thus signals are capable of being transmitted to each other.

Elasticity may be imparted to the support member 34 so as to improve reliability of the contact between the contact point 33 and the conductive layer 32, and thus the support member 34 may be elastically deformed during insertion and separation of the printed circuit board 31.

With reference to FIG. 4, recesses 35 may be formed at both side ends of the printed circuit board 31, and the support member 37 having a latching member 36, which is bent, may be disposed at a position corresponding to the recess 35 when insertion has been completed.

According to the above configurations, the insertion position may be fixed after the printed circuit board 31 is inserted into the support member 37. The printed circuit board 31 may be pulled out by a force that is enough to deform the support member 37.

Figure 5:
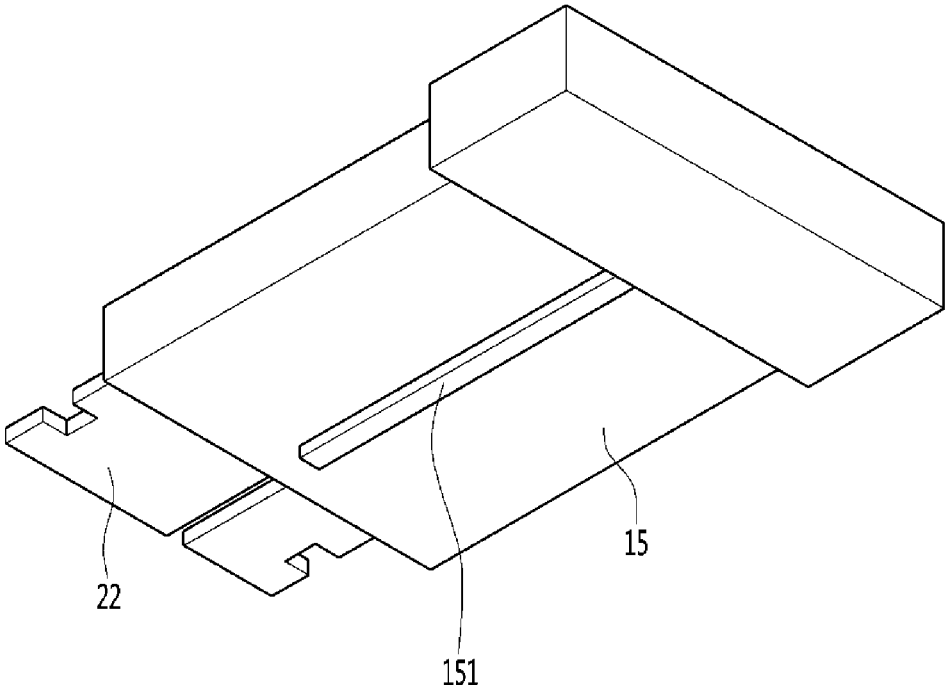
FIG. 5 is a bottom perspective view illustrating a main control module.
Figure 6:
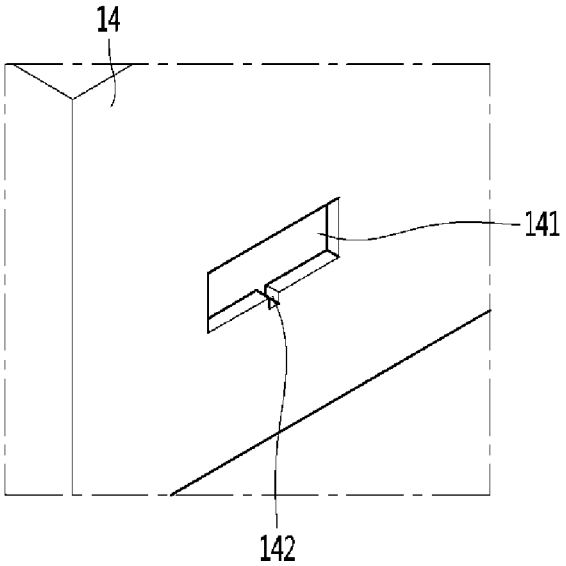
FIG. 6 is an expanded view illustrating a slot into which a second connector is inserted.

FIG. 5 is a bottom perspective view illustrating the main control module. FIG. 6 is an expanded view illustrating a slot in which the second connector is inserted. Other embodiments and configurations may also be provided.

With reference to FIG. 5 and FIG. 6, a rib 151 may extend in a bottom surface of the main control module 15 in a direction in which the main control module 15 is inserted. At a lower long side of the slot 141, an insertion guiding portion 142 may be provided in the form of a groove. When the main control module 15 is inserted into the light control portion 12, the second connector 22 may enter into the slot 141. At this time, the rib 151 may be guided by the insertion guiding portion 142.

In an example in which a vertical direction of the second connector 22 is not aligned with the vertical direction of the slot 141, the rib 151 may not be inserted into the slot 141 by being caught by an outer surface of the slot 141. Therefore, stable conductive coupling between the second connector and the slot may be obtained by the rib 151 and the insertion guiding portion 142. Further, electrical and physical damage of internal components of the light control portion 12 may be suppressed.

The main control module 15 may have a predetermined size and weight because a plurality of components are mounted therein. The weight of the main control module 15 must be stably supported by the light control portion 12 in a state of being fastened to the light control portion 12. Therefore, in order to support the weight of the main control module 15, it may be difficult to use a universal connector; however, the second connector 22 having a predetermined size or larger to support a predetermined weight may be applied.

By using the second connector 22, a stable supporting action may be obtained. The effect of warping (or the like) may be eliminated even by weight of the second connector, so that a stable supporting action may be brought against the conductive contact and the weight of the second connector. The structure of the second connector may be described.

Figure 7:
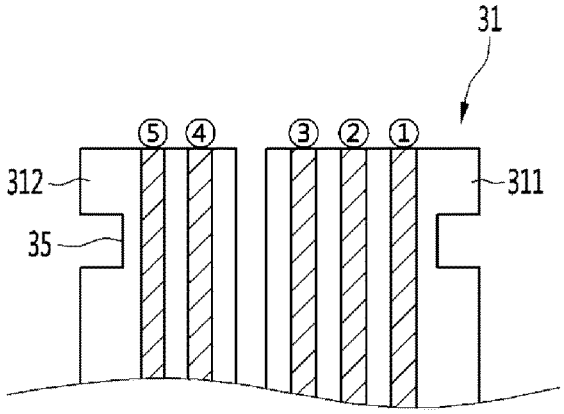
FIG. 7 is an expanded view illustrating a second connector.

FIG. 7 is an expanded view illustrating the second connector. Other embodiments and configurations may also be provided.

As shown in FIG. 7, and as described above, the second connector may include the printed circuit board 31. The printed circuit board 31 may have a plurality of pins. The pins may include a control pin for a control signal, a power pin for power, and/or a mode pin for determining an operation mode of the component.

The control pin may perform a role of transmitting a control signal from the main control module 15 to the light control portion 12. The power pin may perform a role of transmitting power of the light control portion 12 to the main control module 15. The mode pin may perform a role of identifying the control mode of the light control portion 12.

Depending on the role of the pin, the printed circuit board 31 may be divided (or separated) into two portions, namely a first printed circuit board 311 and a second printed circuit board 312. More specifically, the control pin may be provided on the second printed circuit board 312 so that the control signal of the light control portion 12 may be stably transmitted. The power pins may be provided on the first printed circuit board 311 so as not to affect the control signal. This may be to suppress mutual signal interference due to different applied voltages and frequencies of each other.

The mode pin may be provided on the first printed circuit board 311, on which a power pin is provided, since a voltage similar to that of the power pin may be applied. The first printed circuit board 311 and the second printed circuit board 312 may be separated from each other and spaced apart from each other so as to have a waiting space or a physical blocking wall interposed therebetween so as to suppress interference between signals. Different boards may be used for the printed circuit boards.

In the embodiment, ① may be a mode pin, ② and ③ may be ground pins and Vcc, and ④ and ⑤ may be control pins.

Figure 8:
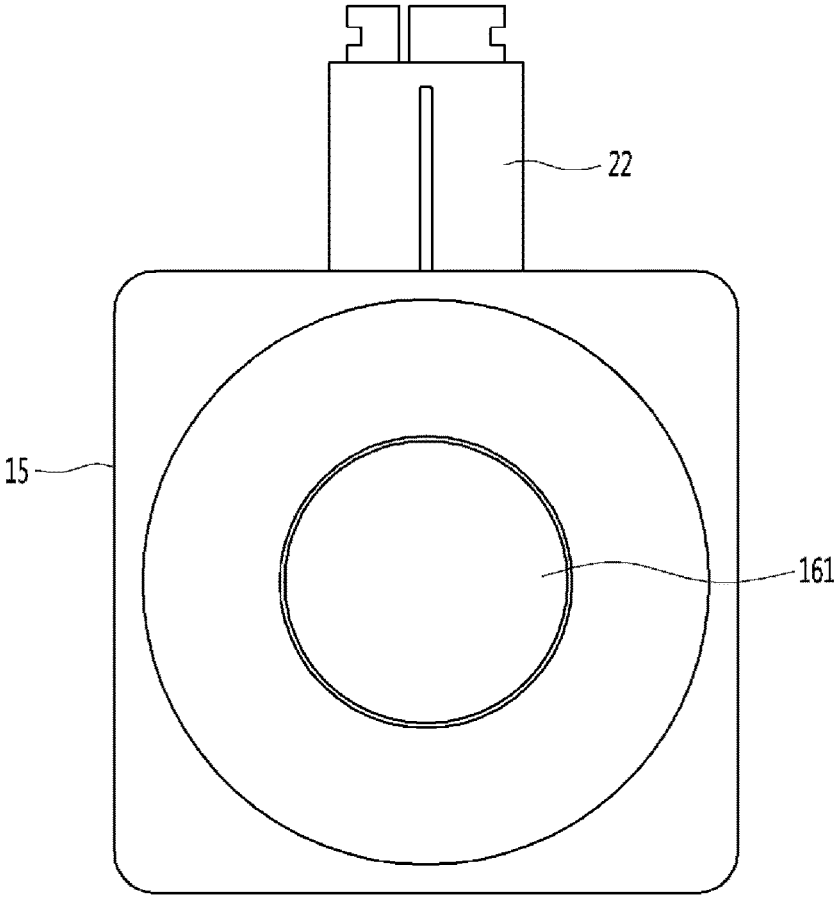
FIG. 8 is a plan view illustrating a main control module according to a embodiment.

FIG. 8 is a plan view illustrating a main control module according to an embodiment. Other embodiments and configurations may also be provided.

FIG. 8 shows that the main control module 15 includes a sensing portion 161.

This embodiment may be applicable to an example where the main control module 15 projects to the outside without being covered by the light irradiation portion 11, or the sensor mounted on the sensing portion 15 senses environmental factors such as temperature and humidity that are not affected by other components of the lighting device such as light irradiation portion 11, Even in this embodiment, the first connector 21 may receive signals from other sensors.

Other embodiments may be included.

Although the sensing portion may be described as being mounted on a lighting device, the sensing portion may be attached to another portion of the ceiling on which the lighting device is installed, a wall, and/or other home appliance. However, since the sensing portion is installed at the lighting device, the desire of the user may be satisfied to use the lighting device independently.

Embodiments may solve problems described above and provide a lighting device in which a user can assemble peripheral components of various lighting devices according to taste of the user.

Embodiments may provide a lighting device that can be easily installed and assembled.

Embodiments may provide a lighting device that enables a sensor, a light emitting unit, and/or a communication module to be commonly used.

Embodiments may provide a lighting device that may be stably operated without damaging the lighting device even when installed by a user.

Embodiments may provide a lighting device in which a user can assemble and use peripheral components of various lighting devices according to taste of the user. The main control module may include a first connector that connects the main control module and the sensor by a wire communication, and a second connector that connects the main control module and a light control portion by the wire communication.

The lighting device may further include a connecting member that is provided at an end of a connecting wire extending from a sensor. The connecting portion and the first connector may be detachably fastened. Additionally, the second connector may be separably fastened to the light control portion.

A UART port (or the like) may be applied to the first connector, and thus the wired communication may be allowed. The uploading of large data to the main control module and the wired communication with the sensing portion may be performed.

A lighting device may be provided that is easily installed and assembled. A printed circuit board may be fixed to a slot based on the slot being provided at the light control portion that controls illuminated light. The printed circuit board may be provided at the second connector.

The lighting device may include an insertion guiding portion that is provided in any one side of the slot and a rib that is lengthened in an inserting direction of the main control module in a main body of the main control module in order to correspond to the insertion guiding portion.

The lighting device may include a recess that is formed on a side of the printed circuit board and a supporting member that is fixed to the light control portion and has a latching member that is elastically deformed in order to latch to the recess.

To enable sharing the sensor, the light emitting unit, and the communication module used in the lighting device (even if the sensor, the light emitting unit, and the communication module are different from each other), the first connector may include a mode pin to identify a type of the sensor and the second connector may include a mode pin capable of identifying a control mode of the light control portion. The mode pin may be a type of pin that uses difference in voltage.

In order to stably operate the lighting device even when a user installs the lighting device, the second connector may include a printed circuit board on which a conductive layer is printed. The second connector may include a first printed circuit board and a second printed circuit board that are spaced apart from each other The first printed circuit board may include a control pin for a control signal that controls the light control portion, and the second printed circuit board may include a power pin for supplying power from the light control portion to the main control module.

Embodiments may construct a lighting device in a desired environment by self-selecting various components in accordance with taste of the user.

Since the sensor, the light emitting unit, and the communication module are constituted by blocks mutually functionalized and can be shared, inventory of components and finished products may be reduced.

Since the installation and assembling are easy, the end user may be capable of purchasing his/her own lighting device and constructing his/her own desired lighting device without visiting a separate installer.

Since the main control module always uses the same article, and peripheral devices such as a sensing portion, a light irradiation portion, and a light control portion are capable of using the different article, component common use is capable of promoting.

Accordingly, components may be shared and inventory may be reduced, and an end user purchases his/her own lighting device and configures his/her desired lighting device by himself/herself, and thus component common use is capable of promoting.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device, comprising:

a light irradiation portion to generate and provide light;

a light control portion to control power applied to the light irradiation portion;

a sensing portion that senses an environment of a space to receive light from the light irradiation portion; and a control module to communicate with an external device by a wireless communication, and the control module to control the light control portion based on a control signal from the external device, wherein the control module includes:

a first connector to couple the control module to the sensing portion by a wired communication, a second connector to couple the light control portion to the control module by the wired communication.

2. The lighting device according to claim 1, further comprising:

a connecting member at a first end of a connecting wire that extends from the sensing portion, and wherein the connecting portion and the first connector are detachably coupled.

3. The lighting device according to claim 1, wherein the first connector to receive an input of information.

4. The lighting device according to claim 1, wherein the first connector includes a mode pin, and the mode pin for receiving information to identify a type of sensor.

5. The lighting device according to claim 1, comprising a sensor mounted at the control module.

6. The lighting device according to claim 1, wherein the sensing portion is disposed at the light irradiating portion or is disposed at a separate position outside of the lighting device.

7. The lighting device according to claim 1, wherein the second connector is separably attached to the light control portion.

8. The lighting device according to claim 7, wherein the second connector includes a printed circuit board and a conductive layer on the circuit board.

9. The lighting device according to claim 8, wherein the printed circuit board includes a first printed circuit board and a second printed circuit, and the second printed circuit board is spaced apart from the first printed circuit board.

10. The lighting device according to claim 9, wherein the first printed circuit board includes a control pin and a power pin, wherein the control pin for receiving a control signal that controls the light control portion, and wherein the power pin for supplying power from the light control portion to the control module.

11. The lighting device according to claim 10, wherein the second printed circuit board includes a mode pin, wherein the mode pin for receiving information to identify a control mode of the light control portion.

12. The lighting device according to claim 11, wherein the control modes of the light control portion are controlled to be different from each other, using difference in voltages applied to the mode pins.

13. The lighting device according to claim 7, wherein the light control portion includes a slot, and the second connector includes a printed circuit board, and wherein the printed circuit board is provided at the slot.

14. The lighting device according to claim 13, comprising:

an insertion guiding portion provided at a side of the slot; and a rib that extends along an inserting direction of the control module to correspond to the insertion guiding portion.

15. The lighting device according to claim 8, comprising:

a recess at a side of the printed circuit board; and a supporting member oat the light control portion, and the supporting member has a latching member to elastically deform in order to latch to the recess.

16. A lighting device, comprising:

a light irradiation portion to provide light;

a light control portion to control power applied to the light irradiation portion;

a sensing portion to sense an environment of a space that receives light from the light irradiation portion;

a control module to communicate with an external device by a wireless communication, and the control module to control the light control portion based on a control signal from the external device; and a first connector provided at the control module, and the first connector to couple the control module to the sensing portion by a wired connection.

17. The lighting device according to claim 16, wherein the first connector includes an UART port.

18. A lighting device, comprising:

a light irradiation portion to provide light;

a light control portion to control power applied to the light irradiation portion;

a sensing portion to sense an environment of a space that receives light from the light irradiation portion;

a control module to communicate with an external device by a wireless communication, and the control module to control the light control portion based on a control signal from the external device; and at least one connector provided at the control module, wherein the at least one connector is to perform uploading of data to the control module based on a wired communication with the sensing portion.

19. The lighting device according to claim 18, wherein the at least one connector includes an UART port.

20. The lighting device according to claim 18, wherein the uploading of data and the wired communication with the sensing portion are performed by a same connector of at least one connector.

* * * * *